US012595025B2

(12) United States Patent
Henderson

(10) Patent No.: US 12,595,025 B2
(45) Date of Patent: Apr. 7, 2026

(54) STEP APPARATUSES FOR BOATS

(71) Applicant: Craig Lee Henderson, Portland, OR (US)

(72) Inventor: Craig Lee Henderson, Portland, OR (US)

( * ) Notice: Subject to any disclaimer, the term of this patent is extended or adjusted under 35 U.S.C. 154(b) by 0 days.

(21) Appl. No.: 19/088,735

(22) Filed: Mar. 24, 2025

(65) Prior Publication Data

US 2025/0223010 A1 Jul. 10, 2025

Related U.S. Application Data

(60) Provisional application No. 63/571,861, filed on Mar. 29, 2024.

(51) Int. Cl.
*B63B 27/14* (2006.01)

(52) U.S. Cl.
CPC ..... *B63B 27/14* (2013.01)

(58) Field of Classification Search
CPC ..... B63B 27/14
See application file for complete search history.

(56) References Cited

U.S. PATENT DOCUMENTS 1,558,425 A * 10/1925 Yetter ..... E04G 3/26 182/113
2,924,291 A * 2/1960 Tunstead ..... B63B 27/14 114/221 R
3,006,434 A * 10/1961 Rich ..... B63B 27/14 182/206
3,056,466 A * 10/1962 Wall, Jr. ..... E06C 1/34 182/214
3,498,410 A * 3/1970 Storch ..... B63B 27/14 182/159
3,590,925 A * 7/1971 Troutner ..... A01B 41/04 172/6
4,157,131 A * 6/1979 Bazyk ..... E06C 5/02 182/206
4,495,883 A * 1/1985 Hoy ..... B63B 27/14 114/364
4,541,507 A * 9/1985 Gibellato ..... B63B 27/14 182/86
5,113,782 A * 5/1992 McCarty ..... B63B 27/146 114/364
5,924,521 A * 7/1999 Crockett ..... B63B 27/14 182/95

(Continued)

FOREIGN PATENT DOCUMENTS

GB 2570492 A * 7/2019 ..... B63B 81/00

*Primary Examiner* — Anthony D Wiest
(74) *Attorney, Agent, or Firm* — Mohr Intellectual Property Law Solutions, PC

(57) ABSTRACT

Boat step apparatuses including a hanger, a step assembly, and a brace. The hanger is configured to selectively mount to a gunnel. The step assembly is coupled to the hanger and includes a kick plate, a pivot mechanism, and a step. The kick plate is coupled to the hanger. The pivot mechanism is coupled to a second major face of the kick plate. The step is mounted to the pivot mechanism. The pivot mechanism moves the step between a stowed configuration and a use configuration. The brace is secured to a first major face of the kick plate and is adapted to abut the boat to horizontally support the kick plate when the hanger is selectively mounted to the gunnel.

11 Claims, 6 Drawing Sheets

(56) References Cited

U.S. PATENT DOCUMENTS

| | | | | |
|---|---|---|---|---|
| 7,464,792 | B2 * | 12/2008 | Adair | E06C 9/08 114/362 |
| 7,475,652 | B2 * | 1/2009 | Dvorak | B63B 27/146 182/95 |
| 7,861,663 | B2 * | 1/2011 | Sedlack | B63B 27/146 182/86 |
| 8,297,215 | B1 * | 10/2012 | Chinn | B63B 27/14 114/362 |
| 9,500,026 | B2 * | 11/2016 | Mountain | E06C 7/48 |
| 9,708,039 | B2 * | 7/2017 | Neese | B63B 27/14 |
| 9,745,026 | B1 * | 8/2017 | Cummings | B63B 27/146 |
| 9,815,529 | B2 * | 11/2017 | Perkins | E04H 4/144 |
| 9,849,943 | B1 * | 12/2017 | Foster | B63B 27/146 |
| 10,427,761 | B2 * | 10/2019 | Grovender | B63B 27/146 |
| 11,912,375 | B1 * | 2/2024 | Padron | B63B 17/00 |
| 2016/0090155 | A1 * | 3/2016 | Eatwell | B63B 27/14 114/345 |

* cited by examiner

STEP APPARATUSES FOR BOATS

CROSS REFERENCE TO RELATED APPLICATIONS

This application claims priority to U.S. Application Ser. No. 63/571,861, filed on Mar. 29, 2024, which is hereby incorporated by reference for all purposes.

BACKGROUND

The present disclosure relates generally to steps for ingress or egress. In particular, removable step apparatuses for boats are described.

Boating is a popular recreational activity and a source of food and/or income for some. Many different types of boats exist with different configurations and features. A common challenge with boats in general is entering and exiting the boat.

Entering and exiting a boat can be challenging because of the way the boat is configured. Boats often have a gunnel that extends a considerable height over surfaces surrounding the boat. Climbing over the gunnel to enter or exit the boat can be difficult and unsafe. Some people lack the strength or mobility to climb over a gunnel and thus are excluded from boating activities or require assistance to partake in boating activities.

Some boats include stairs or ladders to aid with entering or exiting the boat. Boats with stairs and ladders tend to be more expensive than boats without them. A limitation of conventional boats with stairs and ladders is that the location of the stairs and ladders is typically fixed. Fixed location stairs and ladders limit where on the boat they can be used, which may not be where they are needed.

Another limitation with fixed stairs and ladders is that they can not be used in different boats as needed. For example, one going fishing on a friend's boat is not able to readily bring a stair or a ladder to use on the friend's boat when the stair or ladder is permanently installed on another boat.

It would be desirable to have a step apparatus for boats that was useable for a wide variety of boats. It would be advantageous if a boat step apparatus existed that was removable and easily mounted for use on most any boat without requiring one to mechanically fasten it to the boat. Ideally, a boat step apparatus would be lightweight, stable, and strong. Beneficially, the boat step apparatus could be selectively placed in a compact configuration for storage or transport.

Thus, there exists a need for boat step apparatuses that improve upon and advance the design of known approaches to entering and exiting boats. Examples of new and useful removable boat step apparatuses relevant to the needs existing in the field are discussed below.

Disclosure relevant to boat step apparatuses is included in the following U.S. Patent References: U.S. Pat. Nos. 9,849,943 B1, 9,745,026 B1, 9,815,529 B2, U.S. 2016/0090155 A1, U.S. Pat. Nos. 3,498,410 A, 3,590,925 A, 3,006,434 A, 7,861,663 B2, 9,708,039 B2, 3,056,466 A, 4,157,131 A, 4,541,507 A, 5,924,521 A, 7,464,792 B2, 7,475,652 B2, 8,297,215 B1, 9,500,026 B2, and 10,427,761 B2. The complete disclosures of the above patents and patent applications are herein incorporated by reference for all purposes.

SUMMARY

The present disclosure is directed to step apparatuses for a boat. The step apparatuses include a hanger, a step assembly, and a brace. The hanger is configured to selectively mount to a gunnel of a boat.

The step assembly is coupled to the hanger and includes a kick plate, a pivot mechanism, and a step. The kick plate is coupled to the hanger. The kick plate has a first major face and a second major face opposite the first major face. The first major face faces the boat when the hanger is selectively mounted to the gunnel of the boat.

The pivot mechanism is coupled to the second major face of the kick plate. The step is mounted to the pivot mechanism. The pivot mechanism moves the step between a stowed configuration where the step is proximate the kick plate and a use configuration where the step extends perpendicular to the kick plate to enable a user to step on the step.

The brace is secured to the first major face of the kick plate. The brace is adapted to abut the boat to horizontally support the kick plate when the hanger is selectively mounted to the gunnel of the boat.

DETAILED DESCRIPTION

The disclosed step apparatuses will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various step apparatuss are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Contextual Details

Ancillary features relevant to the boat step apparatuses described herein will first be described to provide context and to aid discussing the boat step apparatuses.

Boat

Figure 1:
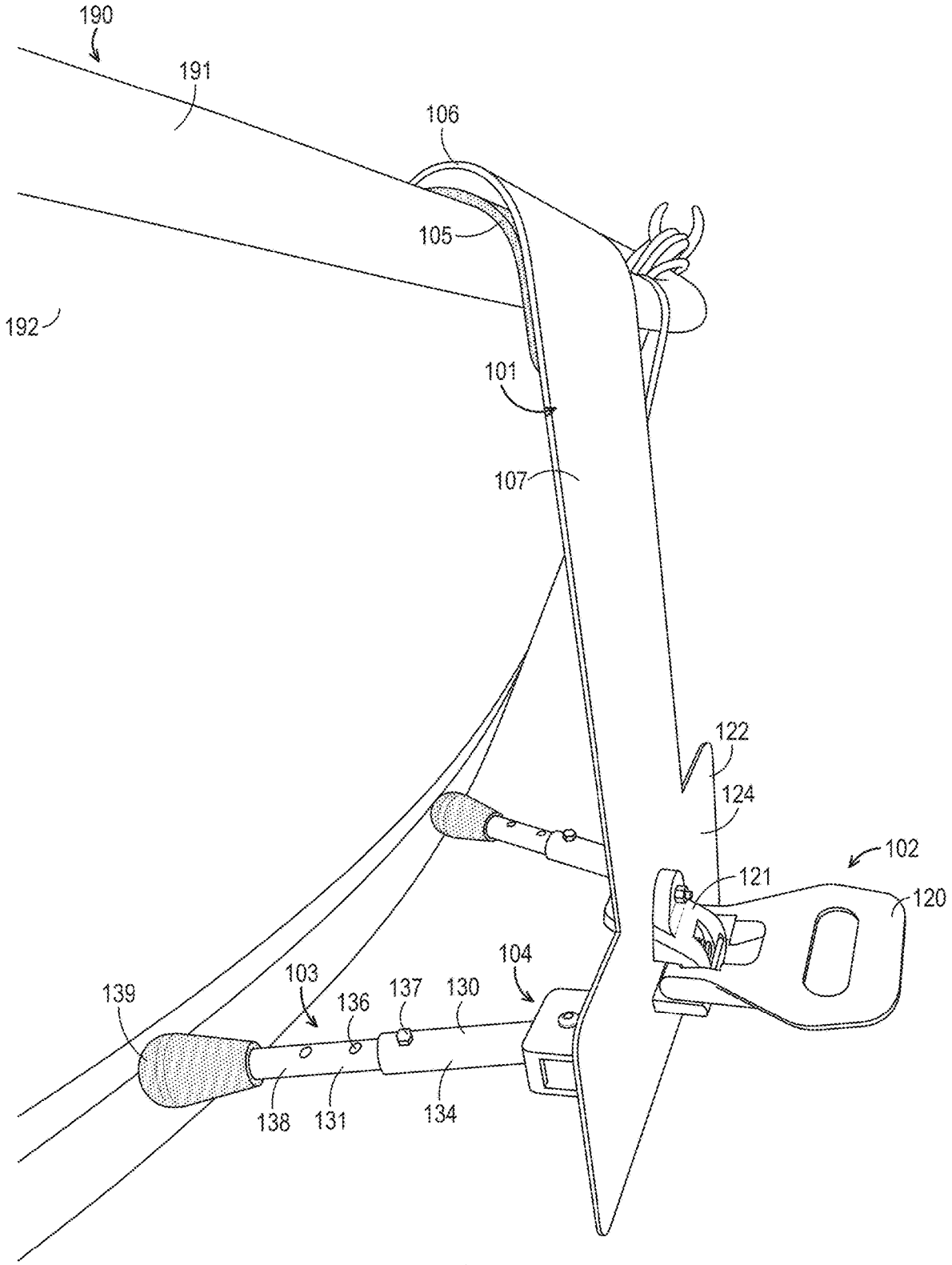
FIG. 1 is a side perspective view of a first embodiment of a boat step apparatus mounted on a boat.
Figure 5:
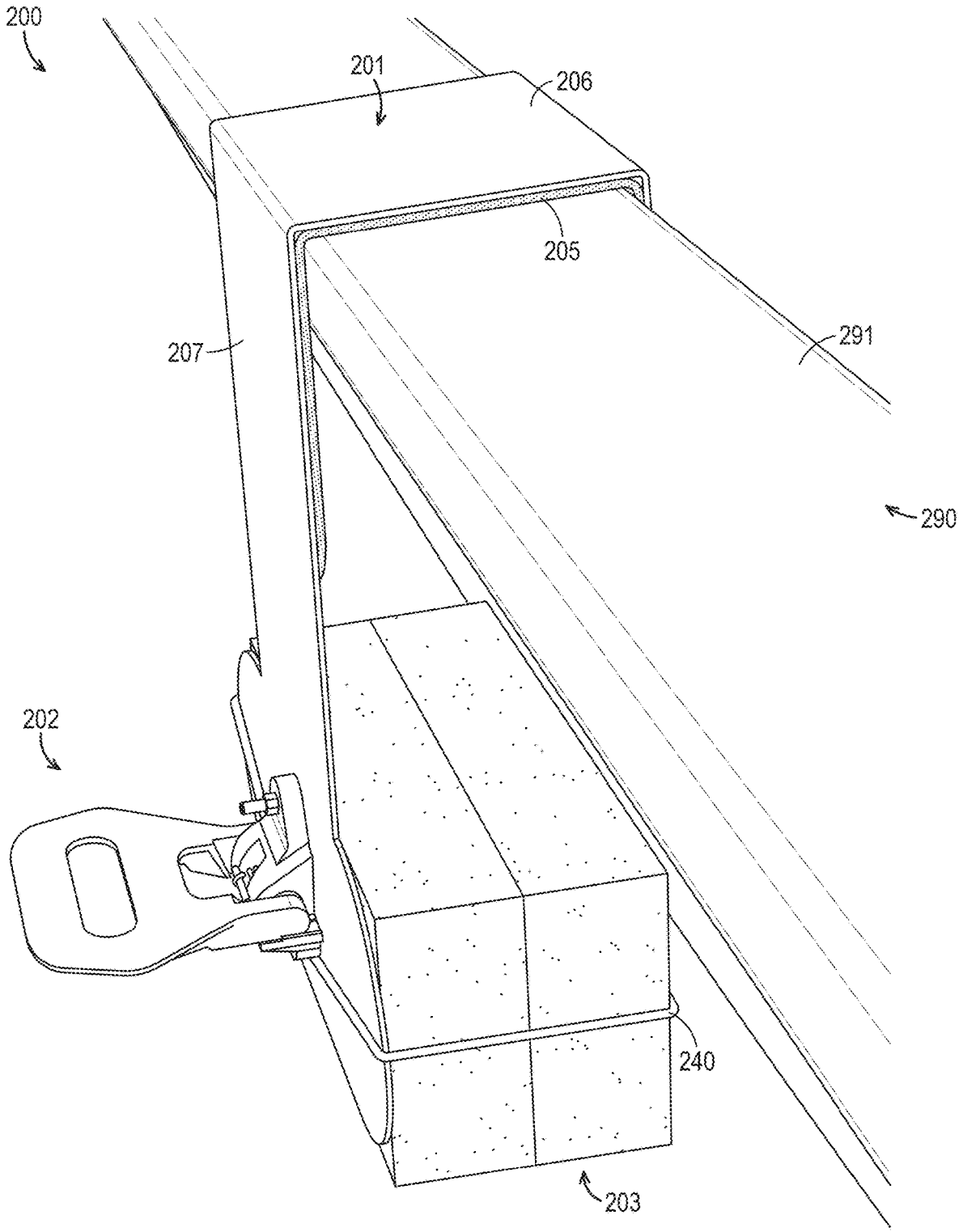
FIG. 5 is a side perspective view of a second embodiment of a boat step apparatus, which has a rectilinear hook and spacer supports.

The boat step apparatuses are typically used to facilitate entering and exiting boats. The boat step apparatuses may be used with a wide variety of boat types, including rigid hull boats, such as drift boats, and inflatable rafts. One example of a suitable boat, boat 190, is shown in FIG. 1. Another suitable boat example, boat 290, is shown in FIG. 5.

Boats 190 and 290 each include a gunnel, 191 and 291, respectively, over which the boat step apparatuses mount. As shown in FIG. 1, gunnel 191 has a curved profile. In contrast, as shown in FIG. 5, gunnel 291 has a flat, rectangular profile. Boats 190 and 290 also each include a hull, 192 and 292, respectively, extending below the gunnels.

The boat step apparatuses described herein may be used with any currently known or later developed type of boat with a gunnel. The gunnels may be a wide variety of shapes, sizes, and types. The boat step apparatuses may be complementarily configured with different types, shapes, and sizes of gunnels.

Step Apparatuses for Boats

With reference to the figures, boat step apparatuses will now be described. The boat step apparatuses discussed herein function to facilitate a person entering or exiting a boat safely and conveniently.

The reader will appreciate from the figures and description below that the presently disclosed boat step apparatuses address many of the shortcomings of conventional approaches to entering and exiting boats.

For example, the novel boat step apparatuses described herein address the difficulties and safety issues associated with attempting to enter or exit a boat without a step or ladder. When using the novel boat step apparatuses, one does not need climb over a tall gunnel from a relatively low surface outside the boat. Instead, the novel boat step apparatuses provide a step serving as an intermediate-height support position to aid the maneuver. By making entering and exiting a boat less dangerous and physically arduous, the novel boat step apparatuses allow more people with strength and mobility limitations to participate in boating activities without requiring assistance.

The novel boat step apparatuses discussed in this document improve upon conventional stairs or ladders included in some boats. One significant improvement provided by the novel removable boat step apparatuses is that people can have a boat step in a less expensive boat that did not come with stairs or ladders installed. With the novel boat step apparatuses, people are no longer required to purchase a more expensive boat with steps or a ladder preinstalled.

Beyond cost benefits, the novel boat step apparatuses improve over conventional boat steps and ladders because they are removable and not fixed to a specific location on a boat. Given their movable nature, the novel boat step apparatuses can be used on a boat wherever they happen to be needed.

Another benefit of the novel boat step apparatuses is that they can be used in different boats as needed. One going fishing on a friend's boat is able to readily bring the novel boat step apparatus to use on the friend's boat.

Desirably, the novel boat step apparatuses may be used in a wide variety of boats. Advantageously, the novel boat step apparatuses are configured for easy mounting and removal without mechanically fastening them to a boat. The novel boat step apparatuses are lightweight, stable, and strong. Beneficially, the novel boat step apparatuses are selectively placed in a compact configuration for storage and transport.

Step Apparatus Embodiment One

Figure 6:
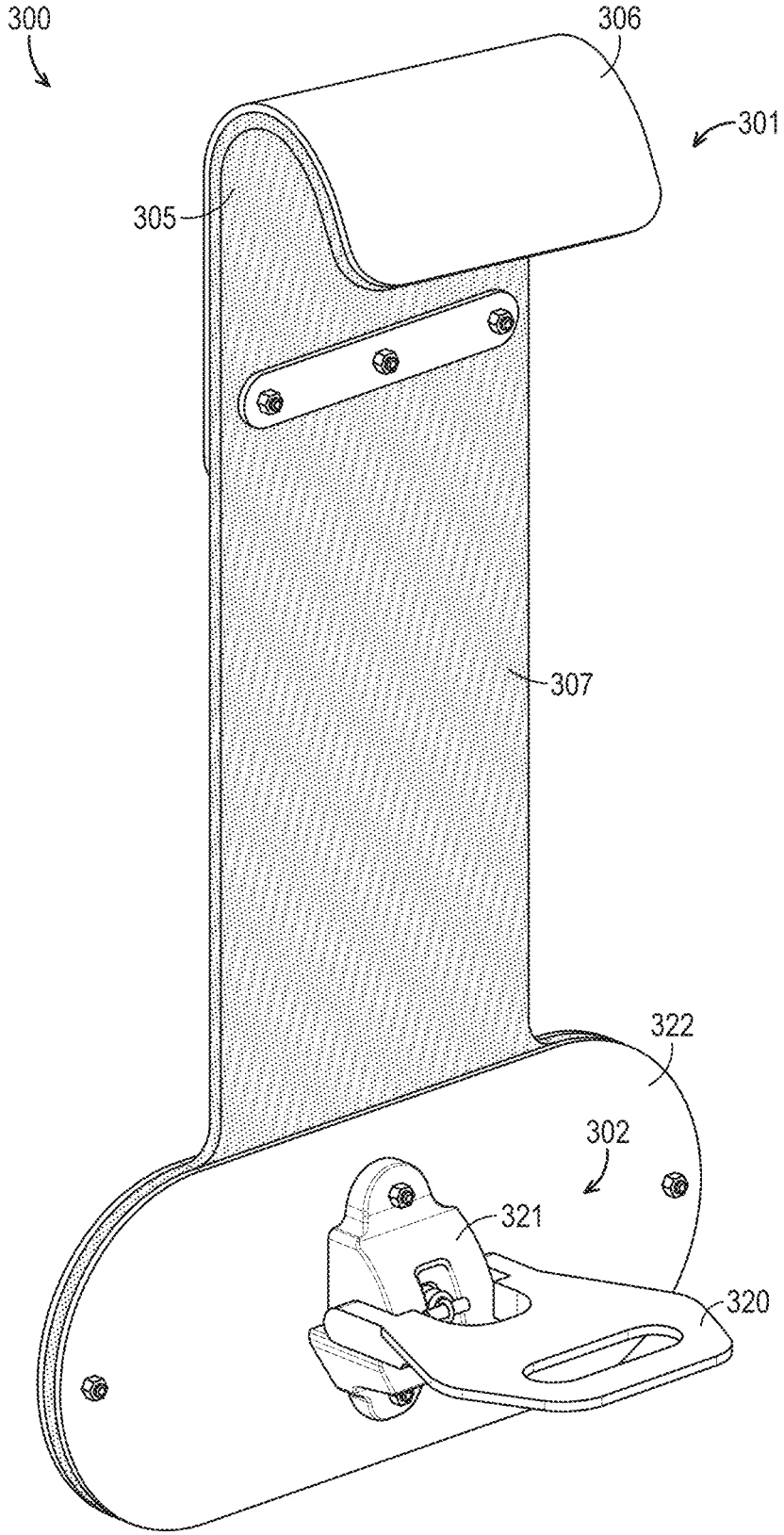
FIG. 6 is a perspective view of a third embodiment of a boat step apparatus, which has a flexible shank.

With reference to FIGS. 1-4, a first example of a step apparatus, step apparatus 100, will now be described. FIG. 5 depicts a second example of a step apparatus, step apparatus 200, which is discussed in the Embodiment Two section below. A third example, step apparatus 300, is shown in FIG. 6 and discussed in the Embodiment Three section below.

Boat step apparatus 100 functions to removably facilitate entering and exiting a boat, such as boat 190 shown in FIG. 1. Boat step apparatus 100 facilitates entering and exiting boat 190 by providing a platform to step onto between a low surface outside boat 190 and the top of gunnel 191.

Boat step apparatus 100 is configured to be selectively mounted to gunnel 191 and selectively removed from gunnel 191. Further, boat step apparatus 100 can be readily transported for use in different boats. When not in use, boat step apparatus 100 is configured to selectively adopt a compact configuration for storage and transport.

As shown in FIGS. 1-4, boat step apparatus 100 includes a hanger 101, a step assembly 102, support members 103, support pivot mechanisms 104, and a cushion 105. The components of boat step apparatus 100 are discussed below.

In some examples, the boat step apparatus does not include one or more features included in boat step apparatus 100. For example, some boat step apparatus examples do not include a pivot mechanism and/or a cushion. In certain examples, the boat step apparatus includes additional or alternative features.

Hanger

Hanger 101 functions to couple boat step apparatus 100 to boat 190. In particular, hanger 101 complements the profile of gunnel 191 and is configured to hang from gunnel 191.

When hanging from gunnel 191, hanger 101 serves to support step assembly 102 at an intermediate position between a top of gunnel 191 and a support surface surrounding boat 190. Supporting step assembly 102 at an intermediate position between the top of gunnel 191 and the support surface surrounding boat 190 provides a platform on which a user may step when entering or exiting boat 190. Stepping onto the platform between the lower surface surrounding boat 190 and the top of gunnel 191 makes it easier to climb over gunnel 191 into or out of boat 190.

Figure 2:
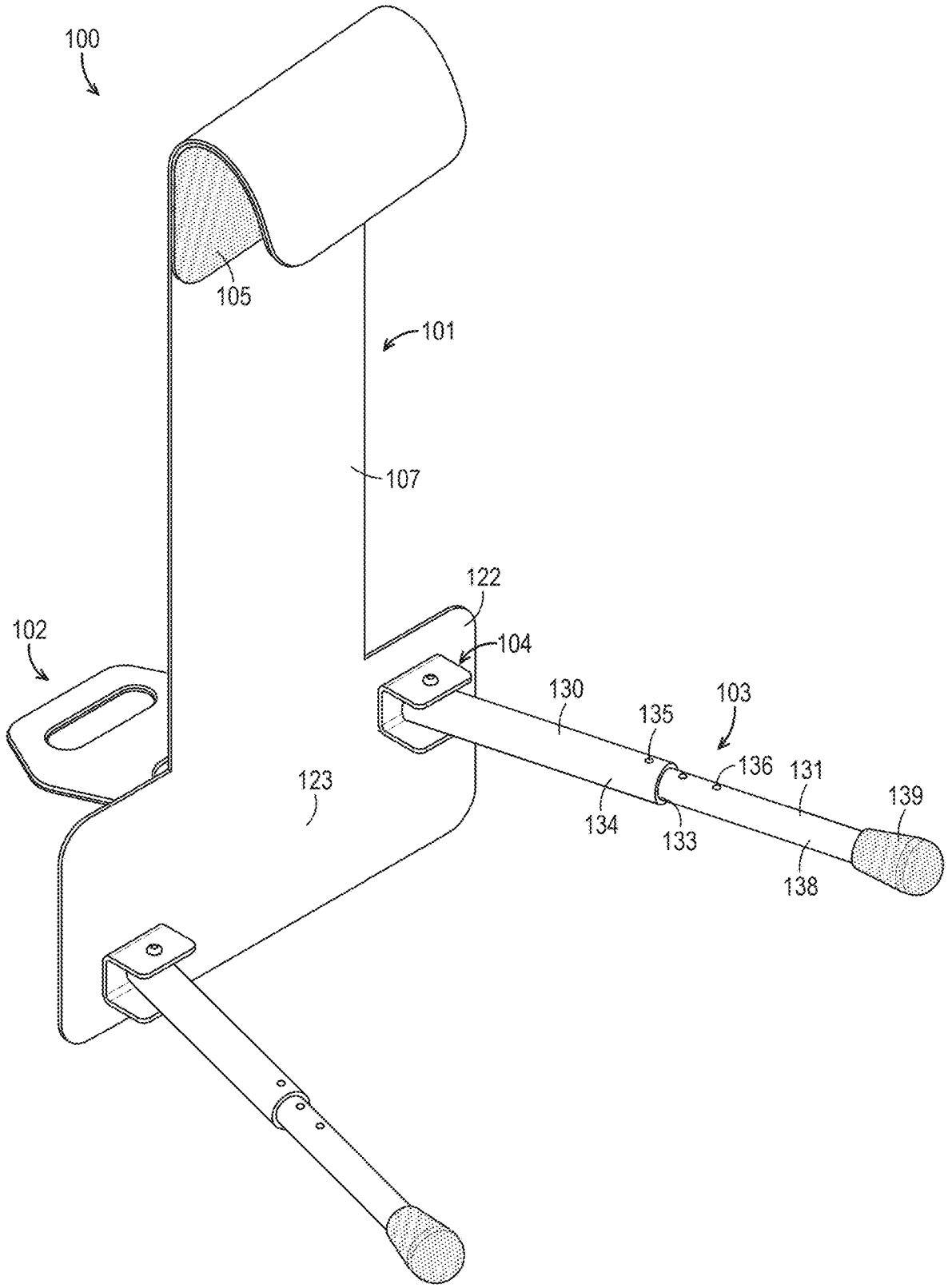
FIG. 2 is a rear perspective view of the boat step apparatus shown in FIG. 1 in a use configuration.
Figure 3:
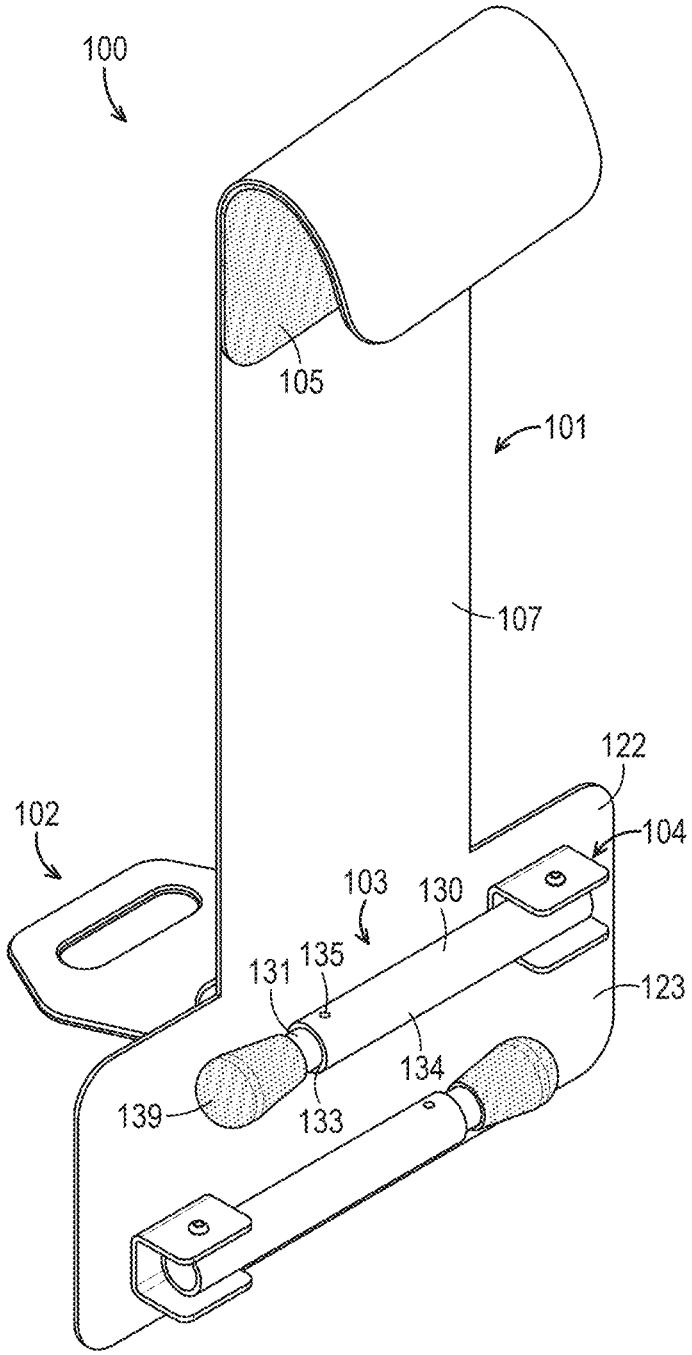
FIG. 3 is a rear perspective view of the boat step apparatus shown in FIG. 1 in a compact configuration.

As shown in FIGS. 1-3, hanger 101 includes a bend 106 and a shank 107. Bend 106 couples to gunnel 191 and shank 107 extends from bend 106. As shown in FIGS. 1-4, step assembly 102 couples to shank 107 distal from bend 106.

In the present example, shank 107 is integrally coupled to bend 106. In other examples, the shank couples to the bend with mechanical fasteners, such as shown in FIG. 6. In some examples, the shank is welded to the bend.

The reader can see in FIGS. 1-3 that bend 106 has a concave curved profile that complements the convex curved profile of gunnel 191. In other examples, the bend may have different shapes to complement gunnels with different shapes. In the example shown in FIG. 5, bend 206 has a flat, angular profile to complement the flat, angular shape of gunnel 291.

In the present example, hanger 101 is comprised of metal. However, the hanger may be formed from any material or combination of materials suitably strong to safely support the weight of a person. For example, as shown in FIG. 6, a shank 307 may be formed from rubber to make shank 307 flexible.

The size of the hanger may vary in different examples. For example, taller and shorter hangers may be used with boats with taller and shorter gunnels, respectively. In addition to the height of the hanger, the width of the hanger may vary as needed.

Step Assembly

Step assembly 102 provides a platform at an intermediate position between a top of gunnel 191 and a support surface surrounding boat 190 on which a user may step when entering or exiting boat 190. Stepping onto the platform between the lower surface surrounding boat 190 and the top of gunnel 191 makes it easier to climb over gunnel 191 into or out of boat 190.

Figure 4:
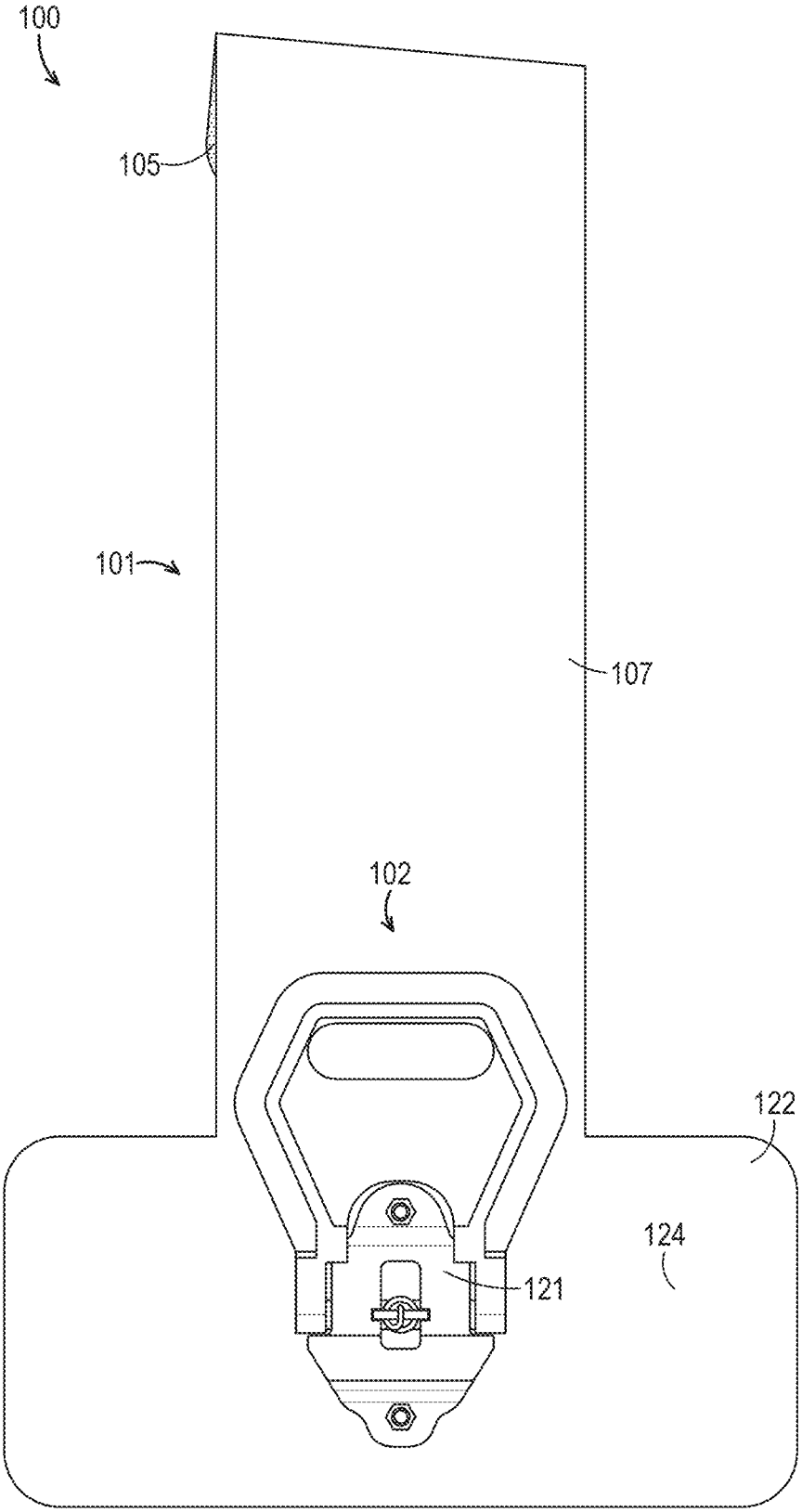
FIG. 4 is a front elevation view of the boat step apparatus shown in FIG. 1 in the compact configuration.

As can be seen in FIGS. 1-4, step assembly 102 is configured to pivot. In particular, step assembly 102 is configured to pivot between a stowed configuration and a use configuration. The use configuration is shown in FIGS. 1-3 and enables a user to step onto step assembly. The stowed configuration shown in FIG. 4 is compact and conducive to storing and transporting boat step apparatus 100.

As shown in FIGS. 1-4, step assembly 102 includes a step 120, a step pivot mechanism 121, and a kick plate 122. Step 120 couples to step pivot mechanism 121 and step pivot mechanism 121 is mounted to kick plate 122.

As depicted in FIGS. 1-4, step 120 is a planar metal member with a textured surface for traction. In the present example, step 120 is chrome-plated steel. However, the step may be steel plated with zinc, may be other types of metal, or may be made from materials other than metal, such as wood, polymers, and composite materials. The surface of the step is not textured in all examples.

As can be seen in FIGS. 1-4, and 5, step 120 defines an optional cutout extending through the planar member. The optional cutout serves as a handle to facilitate moving step 120 between the stowed configuration and the use configuration. The handle also makes it easier to transport boat step apparatus 100. In some examples, the step does not include a cutout.

The top surface of step 120 is perpendicular to kick plate 122 in the use configuration shown in FIGS. 1-3. Step 120 extending perpendicular to kick plate 122 enables a user to step on step 120 when entering or exiting boat 190. In the stowed configuration, the top surface of step 120 is substantially parallel to and facing kick plate 122, which yields an overall compact configuration for boat step apparatus 100.

Step pivot mechanism 121 enables step 120 to move between the stowed configuration and the use configuration. Step pivot mechanism 121 is bolted to kick plate 122 in the present example, but may be welded to the kick plate in other examples. In the example shown in FIGS. 1-4, step 120 and step pivot mechanism 121 are sourced as an integrated unit, but they may be distinct components in other examples.

Pivot mechanism 121 includes a pivot shaft, a rotation bearing, and a biasing spring. The pivot shaft is rotationally mounted on the rotation bearing. Step 120 is coupled to the pivot shaft and rotates between the use configuration and the stowed configuration as the pivot shaft rotates within the rotation bearing. The biasing spring maintains the position of step 120 and the pivot shaft in the use configuration and the stowed configuration until the user deliberately moves the step.

In the present example, kick plate 122 is an aluminum, planar, rectangular member. However, the kick plate may be configured differently or comprised of a different material in other examples.

The reader can see in FIGS. 1-4 that kick plate 122 has a longitudinal dimension oriented perpendicular to a longitudinal dimension of shank 107. Kick plate 122 extends laterally beyond the lateral boundaries of shank 107.

As shown in FIGS. 1-4, kick plate includes a first major face 123 a second major face 124. Second major face 124 is disposed opposite first major face 123. First major face 123 faces boat 190 when hanger 101 is selectively mounted to gunnel 191.

Support pivot mechanisms 104 are welded to first major face 123 of kick plate 122. In particular, support pivot mechanisms 104 are welded to first major face 123 on lateral portions of kick plate 122 that extend beyond shank 107. Step pivot mechanism 121 is attached to second major face 124.

In the present example, kick plate 122 and shank 107 are integrally formed from a single piece of material and represent different regions of a common member. In other examples, the kick plate and the shank are welded together. Some examples do not include a kick plate distinct from the shank. The reader should understand that the step pivot mechanism and the support pivot mechanisms may mount to the shank instead of to a kick plate.

Support Members (Brace)

Support members 103, which may be referred to a brace, function to horizontally brace hanger 101 and step assembly 102 a spaced distance from hull 192. The reader can see in FIG. 1 that hull 192 tapers inwards from gunnel 191, which causes the space between boat step apparatus 100 and boat 190 to increase away from gunnel 191. Support members 103 extend from support pivot mechanisms 104 mounted to kick plate 122 and contact hull 192 to bridge the horizontal gap between kick plate 122 and hull 192.

The reader can see in FIGS. 1-3, that support members 103 are configured to selectively adjust their effective length. As shown in FIGS. 1-3, support members 103 include an internal member 131 moveably mounted within a tube bore 133 defined in an outer member 130. Outer member 130 is a tube with a circular tube wall 134 defining tube bore 133. Internal member 131 may be selectively moved relative to outer member 130 to extend different distances beyond outer member 130, which serves to modify the effective length of support member 103.

The reader can see in FIGS. 1-3, that outer member 130 defines an adjustment hole 135 extending through tube wall 134 and inner member 131 includes a plurality of adjustment holes 136 extending through its tubular wall 138. As shown in FIG. 1, support member 103 includes a bolt 137 configured to selectively extend through adjustment hole 135 in outer member 130 and through a corresponding, aligned adjustment hole 136 defined in inner member 131 to fix the position of inner member 131 relative to outer member 130. Bolt 137 may be selectively removed to allow inner member 131 to move relative to outer member 130 and then selectively inserted and fixed in position when inner member 131 is moved to a desired position relative to outer member 130.

In some examples, the outer member defines a plurality of adjustment holes and the inner member includes a detent extending radially from the tube wall of the inner member. The detent may be configured to selectively extend through a selected adjustment hole in the outer member to fix the position of the inner member relative to the outer member. The detent may be selectively depressed below the inner diameter of the tube wall of the outer member to allow the inner member to move relative to the outer member.

In the present example, support members 103 are comprised of metal and include a rubber foot 139 to increase frictional engagement with hull 192. However, the support members may be comprised of any material suitable for structural support and may not include a rubber foot in all examples. The size, shape, and type of the support members vary in different examples.

Support Pivot Mechanisms

Support pivot mechanisms 104 function to selectively pivot support members 103 between deployed and folded configurations. In the deployed configuration, shown in FIGS. 1 and 2, support pivot mechanisms 104 orient support members 103 transverse to kick plate 122 to enable support members 103 to brace boat step apparatus 100 against hull 192. In the folded configuration shown in FIG. 3, support pivot mechanisms 104 orient support members 103 parallel to kick plate 122, which makes boat step apparatus 100 compact and easy to transport and stow.

As shown in FIGS. 2 and 3, support pivot mechanism 104 is welded to kick plate 122. However, the support pivot mechanism may secure to the kick plate with mechanical fasteners in other examples.

As is apparent from FIGS. 2 and 3, support pivot mechanism 104 defines a hinge. Support pivot mechanism 104 includes two outer walls oriented perpendicularly to kick plate 122. The outer walls each define a bearing aperture through which a pivot shaft is supported. The pivot shaft couples to the outer member of support member 103 to link support member 103 to pivot support mechanism 104.

The pivot support mechanisms may be any currently known or later developed type of hinge or other mechanism enabling the support members to pivot relative to the kick plate. The size and shape of the pivot support mechanisms will vary in different examples.

Cushion

Cushion 105 serves as a protective interface between hanger 101 and gunnel 191. Cushion 105 helps avoid hanger 101 causing damage or wear to gunnel 191 when hanger 101 mounts to gunnel 191 and when the weight of a person stepping on step 120 is transferred to gunnel 191 through hanger 101.

The cushion may be permanently or semi-permanently attached to the hanger or not attached to the hanger. In the example shown in FIGS. 1-4, cushion 105 is bonded to hanger 101. In other examples, the cushion is not attached to the hanger and is positioned between the hanger and the gunnel when needed.

In the example shown in FIGS. 1-4, cushion 105 is comprised of rubber. However, the cushion may be comprised of any suitable material with cushioning properties. The size and shape of the cushion may vary in different examples and applications.

Additional Embodiments

The discussion will now focus on additional boat step apparatus embodiments. The additional embodiments include many similar or identical features to boat step apparatus 100. Thus, for the sake of brevity, each feature of the additional embodiments below will not be redundantly explained. Rather, key distinctions between the additional embodiments and boat step apparatus 100 will be described in detail and the reader should reference the discussion above for features substantially similar between the different boat step apparatus examples.

Second Embodiment

Turning attention to FIG. 5, a second example of a boat step apparatus, boat step apparatus 200, will now be described. As can be seen in FIG. 5, boat step apparatus 200 includes a hanger 201, a step assembly 202, support members 203, and a cushion 205.

The reader can see in FIG. 5 that the shape of hanger 200 differs from hanger 100. Hanger 200 has a bend 206 with a concave square profile rather than the concave curved profile of bend 106. The reader can see in FIG. 5 that the concave square profile of bend 206 complements the convex square profile of gunnel 291.

Brace or support members 203 are also different in boat step apparatus 200 than in boat step apparatus 100. As shown in FIG. 5, support members 203 are stacked foam blocks rather than telescoping arms like in support members 103. Support members 203 in the form of foam blocks serve the same purpose of bracing hanger 203 from hull 292 of boat 290. The blocks may be formed from materials other than foam, such as wood, metals, polymers, and composite materials.

Support members 203 are secured to step assembly 202 with a cord 240. Cord 240 is elastic, but any type of cord or other elongate tension bearing member may be used to couple the support members to the step assembly.

Another distinction between boat step apparatus 200 and boat step apparatus 100 is that boat step apparatus 200 does not include support pivot mechanisms. Support pivot mechanisms are not necessary or applicable with support members 203 in the form of foam blocks.

Third Embodiment

Turning attention to FIG. 6, a third example of a boat step apparatus, boat step apparatus 300, will now be described. As can be seen in FIG. 6, boat step apparatus 300 includes a hanger 301, a step assembly 302, and a cushion 305. Like in prior embodiments, step assembly 302 includes a step 320, a step pivot mechanism 321, and a kick plate 322.

The reader can see in FIG. 6 that hanger 301 differs from hanger 101. In particular, instead of being entirely rigid, hanger 301 includes a rigid bend 306 and a flexible shank 307. Flexible shank 307 is comprised of rubber and enables step assembly 302 to swing freely from bend 306.

Flexible shank 307 makes boat step apparatus 300 well suited for use inflatable raft type boats. However, boat step apparatus 300 may be used with any type of boat, such as drift boats and other rigid hull boats.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A step apparatus for a boat, comprising:

a hanger configured to selectively mount to a gunnel of a boat;

a step assembly coupled to the hanger, the step assembly including:

a kick plate coupled to the hanger, the kick plate having:

a first major face facing the boat when the hanger is selectively mounted to the gunnel of the boat; and a second major face opposite the first major face;

a pivot mechanism coupled to the second major face of the kick plate; and a step mounted to the pivot mechanism, the pivot mechanism moving the step between a stowed configuration where the step is proximate the kick plate and a use configuration where the step extends perpendicular to the kick plate to enable a user to step on the step; and a brace secured to the first major face of the kick plate and adapted to abut the boat to horizontally support the kick plate when the hanger is selectively mounted to the gunnel of the boat;

wherein:

the brace is length adjustable;

the brace is pivotally mounted to the first major face of the kick plate;

the brace includes:

a first telescoping arm;

a second telescoping arm pivotally mounted to the first major face of the kick plate and laterally spaced from the first telescoping arm;

the first telescoping arm and the second telescoping arm are configured to pivot towards a medial portion of the kickplate;

the second telescoping arm is vertically spaced from the first telescoping arm; and the first telescoping arm and the second telescoping arm extend parallel to the kickplate and parallel to each other when pivoted towards the medial portion of the kickplate.

2. The step apparatus of claim 1, wherein the telescoping arm includes:

an outer tubular member; and an inner tubular member moveably disposed within the outer tubular member.

3. The step apparatus of claim 2, wherein:

the outer tubular member defines an outer adjustment hole;

the inner tubular member defines a plurality of longitudinally spaced inner adjustment holes; and the brace includes a shaft configured to insert through the outer adjustment hole and a selected inner adjustment hole aligned with the outer adjustment hole to restrict the inner tubular member moving relative to the outer tubular member.

4. The step apparatus of claim 1, wherein the telescoping arm includes a foot disposed proximate the boat.

5. The step apparatus of claim 4, wherein the foot is configured to avoid damaging the boat when the brace presses against the boat.

6. The step apparatus of claim 5, wherein the foot is configured to increase frictional engagement of the brace with the boat when the brace abuts the boat to resist the brace sliding relative to the boat.

7. The step apparatus of claim 1, wherein the hanger supports the step assembly at an intermediate position between a top of the gunnel and a support surface surrounding the boat to facilitate a user entering the boat from the support surface by stepping on the step assembly.

8. The step apparatus of claim 1, wherein the hanger includes:

a bend configured to selectively mount to the gunnel of the boat; and a shank integrally coupled to the bend and coupled to the step assembly.

9. The step apparatus of claim 8, wherein the bend has a concave curved profile.

10. The step apparatus of claim 8, wherein the bend has a concave rectilinear profile.

11. The step apparatus of claim 8, wherein the shank is a rigid member.

* * * * *